US010319513B2

(12) United States Patent
Miyamoto et al.

(10) Patent No.: US 10,319,513 B2
(45) Date of Patent: Jun. 11, 2019

(54) COMMON MODE CHOKE COIL

(71) Applicant: MURATA MANUFACTURING CO., LTD., Kyoto-fu (JP)

(72) Inventors: Masashi Miyamoto, Nagaokakyo (JP); Shigeto Yamamoto, Nagaokakyo (JP); Kentaro Yamaguchi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 15/371,703

(22) Filed: Dec. 7, 2016

(65) Prior Publication Data

US 2017/0169935 A1 Jun. 15, 2017

(30) Foreign Application Priority Data

Dec. 15, 2015 (JP) ..... 2015-243692

(51) Int. Cl.

| | |
|---|---|
| ***H01F 17/04*** | (2006.01) |
| ***H01F 27/29*** | (2006.01) |
| ***H01F 27/28*** | (2006.01) |
| ***H01F 17/03*** | (2006.01) |
| ***H01F 19/04*** | (2006.01) |
| *H01F 17/00* | (2006.01) |

(52) U.S. Cl.

CPC ..... *H01F 27/29* (2013.01); *H01F 17/03* (2013.01); *H01F 17/045* (2013.01); *H01F 19/04* (2013.01); *H01F 27/2823* (2013.01); *H01F 27/2828* (2013.01); *H01F 27/292* (2013.01); *H01F 2017/0093* (2013.01)

(58) Field of Classification Search

None

See application file for complete search history.

(56) References Cited

U.S. PATENT DOCUMENTS 9,659,701 B2 * 5/2017 Tomonari ..... H01F 17/045

FOREIGN PATENT DOCUMENTS

| | | | |
|---|---|---|---|
| CN | 103887040 | A | 6/2014 |
| JP | 2010-093184 | A | 4/2010 |
| JP | 2014-120730 | A | 6/2014 |

(Continued)

OTHER PUBLICATIONS

English translation of JP2002313634A.*

(Continued)

*Primary Examiner* — Ronald Hinson

(74) *Attorney, Agent, or Firm* — Studebaker & Brackett PC

(57) ABSTRACT

A common mode choke coil includes a core having a winding core part and a first and second wire wound around the winding core part. The winding core part has a first winding region, a switching region and second winding regions in this order along the axis of the winding core part. In the first winding region, each turn of the first wire is located closer to a first end portion of the winding core part than the corresponding same-numbered turn of the second wire. In the second winding region, each turn of the first wire is located closer to a second end portion of the winding core part than the corresponding same-numbered turn of the second wire. The number of turns of the first and second wires in the first winding region differs from the number of turns of the first and second wires in the second winding region.

8 Claims, 13 Drawing Sheets

(56) References Cited

FOREIGN PATENT DOCUMENTS

JP 2014-199904 A 10/2014

OTHER PUBLICATIONS

Notification of the First Office Action issued by the State Intellectual Property Office of the People's Republic of China dated Feb. 28, 2018, which corresponds to Chinese Patent Application No. 201610987076.7 and is related to U.S. Appl. No. 15/371,703.

An Office Action; "Notification of Reasons for Refusal," Mailed by the Japanese Patent Office dated Jul. 3, 2018, which corresponds to Japanese Patent Application No. 2015-243692 and is related to U.S. Appl. No. 15/371,703; with English language translation.

* cited by examiner

<EQUAL-NUMBER-OF-TURNS>

<ONE-TURNS-LESS>

<SEVEN-TURNS-LESS>

– PRIOR ART –

- PRIOR ART -

– PRIOR ART –

COMMON MODE CHOKE COIL

CROSS REFERENCE TO RELATED APPLICATIONS

This application claims benefit of priority to Japanese Patent Application 2015-243692 filed Dec. 15, 2015, the entire content of which is incorporated herein by reference.

TECHNICAL FIELD

The present disclosure relates to a common mode choke coil, in particular, a wire-wound common mode choke coil with two wires wound around a winding core part having two end portions.

BACKGROUND

Referring to FIGS. 11 and 12, a general configuration of a common mode choke coil 31 will be described.

As illustrated in FIG. 11, the common mode choke coil 31 includes a core 32, and first and second wires 33 and 34 each forming an inductor. The core 32 is made of an electrical insulating material, more specifically, a material such as alumina as an example of a dielectric, a Ni—Zi-based ferrite as an example of a magnetic material, or resin. The core 32 has a substantially rectangular cross-sectional shape as a whole. The wires 33 and 34 are formed by, for example, a copper wire with an insulating coating.

The core 32 has a winding core part 35, and first and second flange parts 36 and 37 provided at opposite end portions of the winding core part 35. The first and second wires 33 and 34 are wound around the winding core part 35 in a substantially helical manner with a substantially equal number of turns while running parallel to each other from a first end portion 38 where the first flange part 36 is located toward a second end portion 39 where the second flange part 37 is located.

First and second terminal electrodes 41 and 42 are provided in the first flange part 36, and third and fourth terminal electrodes 43 and 44 are provided in the second flange part 37. The terminal electrodes 41 to 44 are formed by a method such as baking of an electrically conductive paste or plating of an electrically conductive metal. As can be appreciated from the locations of the terminal electrodes 41 to 44, FIG. 11 depicts the common mode choke coil 31 in such a position that its mounting surface, which is orientated toward the mount board, faces upward.

Opposite end portions of the first wire 33 are connected to the first and third terminal electrodes 41 and 43, and opposite end portions of the second wire 34 are connected to the second and fourth terminal electrodes 42 and 44. These connections are made by, for example, thermo-compression bonding.

The common mode choke coil 31 further includes a top plate 45. Like the core 32, the top plate 45 is made of an electrical insulating material, more specifically, a material such as alumina as an example of a dielectric, a Ni—Zi-based ferrite as an example of a magnetic material, or resin. If the core 32 and the top plate 45 are each made of a magnetic material, when the top plate 45 is disposed so as to connect the first and second flange parts 36 and 37 with each other, the core 32 forms a closed magnetic circuit in cooperation with the top plate 45.

The common mode choke coil 31 configured as described above gives an equivalent circuit as illustrated in FIG. 12. In FIG. 12, elements corresponding to those illustrated in FIG. 11 are denoted by the same reference signs.

Referring to FIG. 12, the common mode choke coil 31 includes a first inductor 46, and a second inductor 47. The first inductor 46 is formed by the first wire 33 connected between the first and third terminal electrodes 41 and 43. The second inductor 47 is formed by the second wire 34 connected between the second and fourth terminal electrodes 42 and 44. The first and second inductors 46 and 47 are magnetically coupled to each other.

Although not clearly illustrated in FIG. 11, the first wire 33 is wound so as to form a first layer that contacts the peripheral surface of the winding core part 35, and the second wire 34 is wound so as to form a second layer on the outer side of the first layer, with a part of the second wire 34 fitting in the recess defined between adjacent turns of the first wire 33.

A problem often encountered by the common mode choke coil 31 mentioned above with increased frequency of signals input to the common mode choke coil 31 is the increased mode conversion characteristics, which represent the proportion of input differential signal components that are converted into and output as common mode noise. For example, Japanese Unexamined Patent Application Publication No. 2014-120730 cites imbalance in stray capacitance (distributed capacitance) generated between different turns of the first and second wires 33 and 34 as the cause of this problem.

Accordingly, the technique disclosed in Japanese Unexamined Patent Application Publication No. 2014-120730 employs, for example, the manner of winding the wires 33 and 34 as illustrated in FIG. 13.

In FIG. 13, the cross-sections representing the first wire 33 are shaded to clearly distinguish the first wire 33 from the second wire 34. Further, the ordinal numbers of turns "1" to "12" as counted from the first end portion 38 of the winding core part 35 are written within the respective cross-sections of the first and second wires 33 and 34 illustrated in FIG. 13.

In FIG. 13, among various portions of the first and second wires 33 and 34 wound around the winding core part 35, the portions located forward of the winding core part 35 and the portions hidden behind the winding core part 35 are schematically indicated respectively by solid and broken lines. It is to be noted that FIG. 13 does not depict all of the portions of the wires 33 and 34 located forward of the winding core part 35 and hidden behind the winding core part 35.

Referring to FIG. 13, the winding core part 35 has a first winding region A, a switching region C, and a second winding region B in this order along the axis of the winding core part 35.

(1) In the first winding region A, the respective same-numbered turns of the first and second wires 33 and 34 lie adjacent to each other with each turn of the first wire 33 being located closer to the first end portion 38 than the corresponding same-numbered turn of the second wire 34.

(2) In the second winding region B, the respective same-numbered turns of the first and second wires 33 and 34 lie adjacent to each other with each turn of the first wire 33 being located closer to the second end portion 39 than the corresponding same-numbered turn of the second wire 34.

(3) In the switching region C located between the first winding region A and the second winding region B, the first wire and the second wire 34 cross each other such that the relative positions of the turns of the first wire 33 and the turns of the second wire 34 are switched.

In addressing the problem of increased mode conversion, the technique described in Japanese Unexamined Patent Application Publication No. 2014-120730 makes the winding structure of the wires 33 and 34 in the first winding region A and the winding structure of the wires 33 and 34 in the second winding region B symmetric about a centerline C1 of the switching region C in order to balance out stray capacitances (distributed capacitances) generated between different turns of the first and second wires 33 and 34. In other words, the number of turns of each of the wires 33 and 34 in the first winding region A, and the number of turns of each of the wires 33 and 34 in the second winding region B are made substantially equal to each other.

According to Japanese Unexamined Patent Application Publication No. 2014-120730, the winding structure of the wires 33 and 34 is made symmetric as mentioned above so that the distributed capacitance in the first winding region A and the distributed capacitance in the second winding region B are respectively generated in parallel to the first and second inductors 46 and 47 (see FIG. 12). This causes the resonance point of the LC circuit formed by the first wire 33 and the resonance point of the LC circuit formed by the second wire 34 to both change, but the balance between the two resonance points remains unchanged, thus making it possible to reduce mode conversion.

SUMMARY

The technique described in Japanese Unexamined Patent Application Publication No. 2014-120730 employs the symmetric winding structure of the wires 33 and 34 mentioned above to reduce mode conversion. In actuality, however, it is nearly impossible to achieve a perfect symmetry of the winding structure for the common mode choke coil 31.

For example, the wires 33 and 34 are wound in a substantially helical manner, which means that any attempt to physically position the wires 33 and 34 in a laterally symmetrical fashion does not result in prefect symmetry.

Further, since the two wires 33 and 34 are wound so as to substantially maintain a positional relationship such that the first wire 33 is always located at the inner side and the second wire 34 is always located at the outer side, a difference in inductance value is maintained between the first inductor 46 formed by the first wire 33 and the second inductor 47 formed by the second wire 34. Thus, the resonant frequency does not match between the first inductor 46 and the second inductor 47.

To mount the common mode choke coil 31 of a chip type onto a mount board, the common mode choke coil 31 is soldered by use of the terminal electrodes 41 to 44. At this time, owing to various factors such as the shapes of the terminal electrodes 41 to 44 or the shapes of electrically conductive lands on the mount board, the soldering applied to each of the terminal electrodes 41 to 44 tends to become uneven, which also introduces asymmetry.

It has been found that the asymmetry introduced to the winding structure or portions other than the winding structure in this way also introduces asymmetry, that is, directionality to electrical characteristics such as inductance and capacitance. Such directionality makes it impossible to achieve mode-conversion reduction as suggested by theory.

Accordingly, it is an object of the present disclosure to provide a common mode choke coil that allows mode conversion to be reduced without pursuing symmetry.

A common mode choke coil according to one embodiment of the present disclosure includes a core having a winding core part, and a first flange part and a second flange part respectively provided in a first end portion and a second end portion of the winding core part, the first and second end portions being located opposite to each other, a first wire and a second wire that are wound around the winding core part in a substantially helical manner with substantially equal number of turns while running parallel to each other, a first terminal electrode and a second terminal electrode that are provided in the first flange part, the first terminal electrode and the second terminal electrode being respectively connected with a first end of the first wire and a first end of the second wire, and a third terminal electrode and a fourth terminal electrode that are provided in the second flange part, the third terminal electrode and the fourth terminal electrode being respectively connected with a second end of the first wire and a second end of the second wire.

The winding core part has a first winding region, a switching region, and a second winding region in this order along an axis of the winding core part.

In the first winding region, the respective same-numbered turns of the first and second wires lie adjacent to each other, with each turn of the first wire being located closer to the first end portion than the corresponding same-numbered turn of the second wire.

In the second winding region, the respective same-numbered turns of the first and second wires lie adjacent to each other with each turn of the first wire being located closer to the second end portion than the corresponding same-numbered turn of the second wire.

In the switching region, the first wire and the second wire cross each other such that the relative positions of the turns of the first wire and the turns of the second wire are switched.

In the common mode choke coil configured as described above, number of turns of the first and second wires in the first winding region differs from number of turns of the first and second wires in the second winding region.

As described above, to address the above-mentioned problem, the present disclosure relies on asymmetry, which runs counter to the symmetry pursued by the technique described in Japanese Unexamined Patent Application Publication No. 2014-120730. It has been found that this configuration results in improved mode conversion characteristics compared to physically symmetric configurations.

The reliance on asymmetry as mentioned above introduces directionality to the electrical characteristics of the common mode choke coil. Accordingly, the common mode choke coil according to another embodiment of the present disclosure preferably further includes a mark that discriminates between the first flange part and the second flange part.

In the common mode choke coil according to another embodiment of the present disclosure, preferably, the number of turns of the first and second wires in one region of the first winding region and the second winding region is more than or equal to 1.5 times that in the other region of the first winding region and the second winding region.

In the common mode choke coil according to another embodiment of the present disclosure, preferably, a difference between the number of turns of the first and second wires in the first winding region and the number of turns of the first and second wires in the second winding region is more than or equal to five.

The common mode choke coil according to another embodiment of the present disclosure may employ any one of the first and second winding arrangements described below for the first and second wires.

With the first winding arrangement, the first wire is wound such that the first wire forms a first layer in contact with the peripheral surface of the winding core part, and in the first and second winding regions, the second wire is wound such that the second wire forms a second layer on the outer side of the first layer, with a part of the second wire fitting in a recess defined between adjacent turns of the first wire.

With the second winding arrangement, in the first and second winding regions, the first wire and the second wire are both wound in contact with the peripheral surface of the winding core part.

The common mode choke coil according to one embodiment of the present disclosure allows for improved mode conversion characteristics observed from a given direction compared to arrangements in which the first and second wires have a physically symmetric winding structure.

In a common mode choke coil, owing to its inherent structure, top-bottom or left-right asymmetry always develops with regard to inductance or capacitance in portions of the coil other than the wire windings. Such asymmetry is determined by factors such as the positional relationship between the first and second wires to be wound or the positional relationship between the terminal electrodes and the electrically conductive lands on the mount board, and thus directionality is always present.

The present disclosure actively makes the number of turns of the first and second wires different between the first winding region and the second winding region, thus compensating for the above-mentioned asymmetry to achieve improved characteristics.

Other features, elements, characteristics and advantages of the present disclosure will become more apparent from the following detailed description with reference to the attached drawings.

DETAILED DESCRIPTION

Figure 1A:
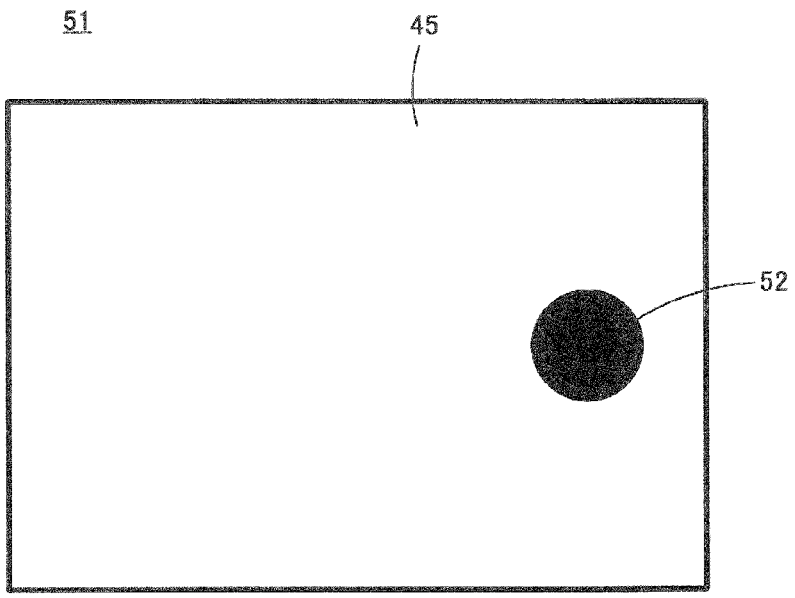
FIGS. 1A and 1B are respectively a plan view and a bottom view illustrating the outward appearance of a common mode choke coil according to a first embodiment of the present disclosure.
Figure 1B:
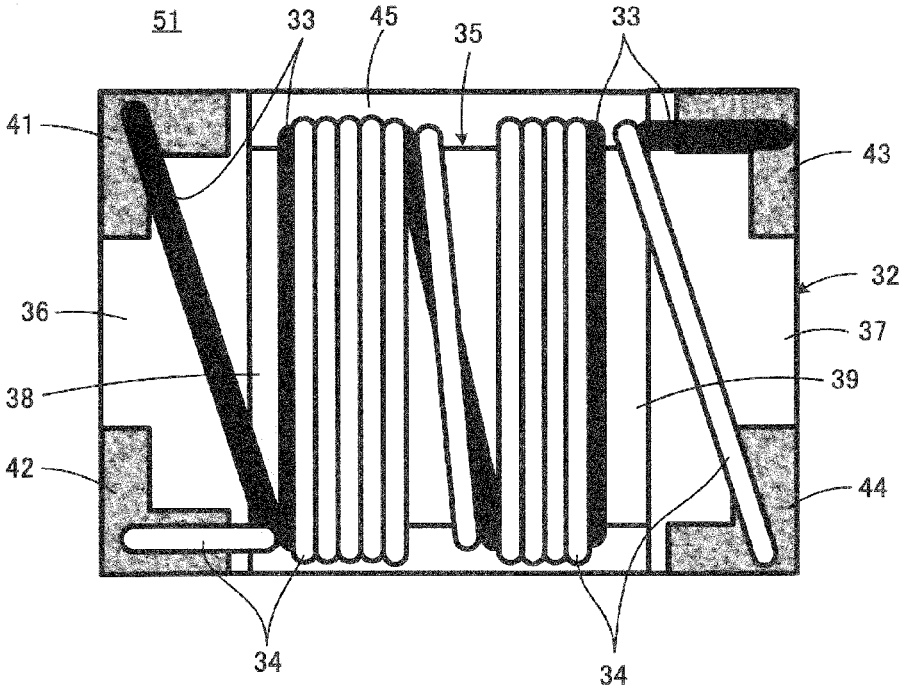
Figure 11:
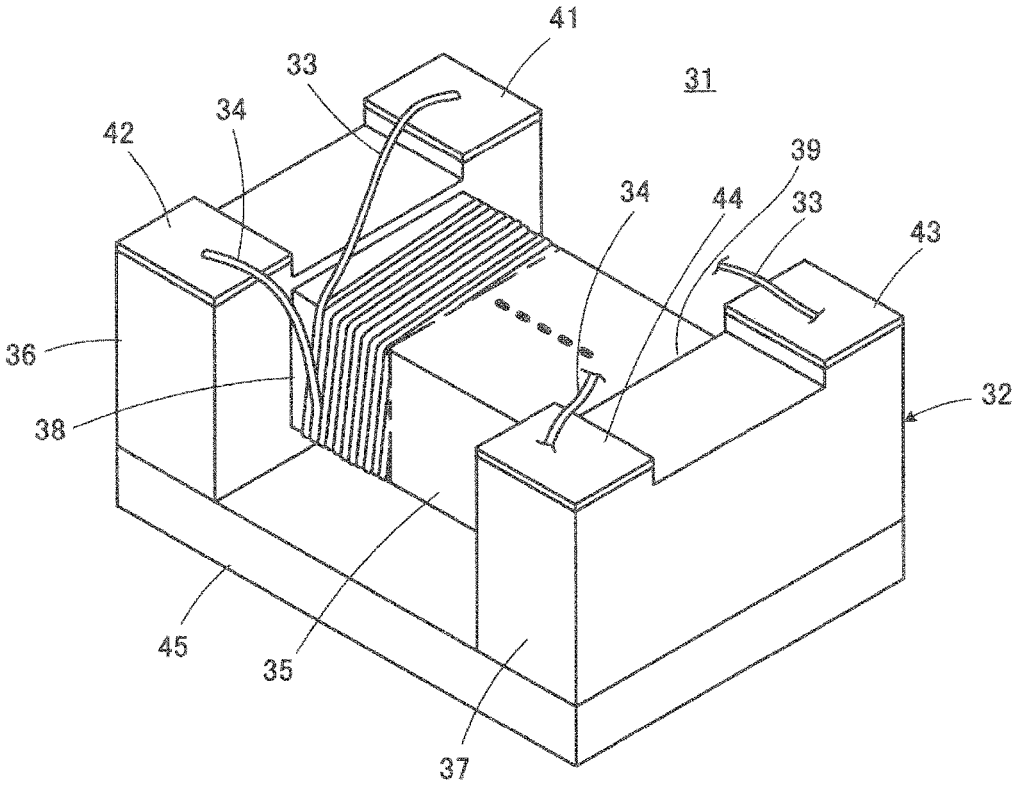
FIG. 11 is a perspective view illustrating the outward appearance of a common mode choke coil according to related art.
Figure 12:
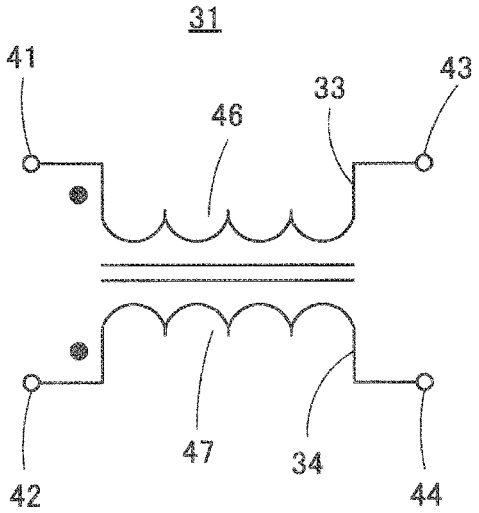
FIG. 12 is an equivalent circuit diagram of the common mode choke coil illustrated in FIG. 11.
Figure 13:
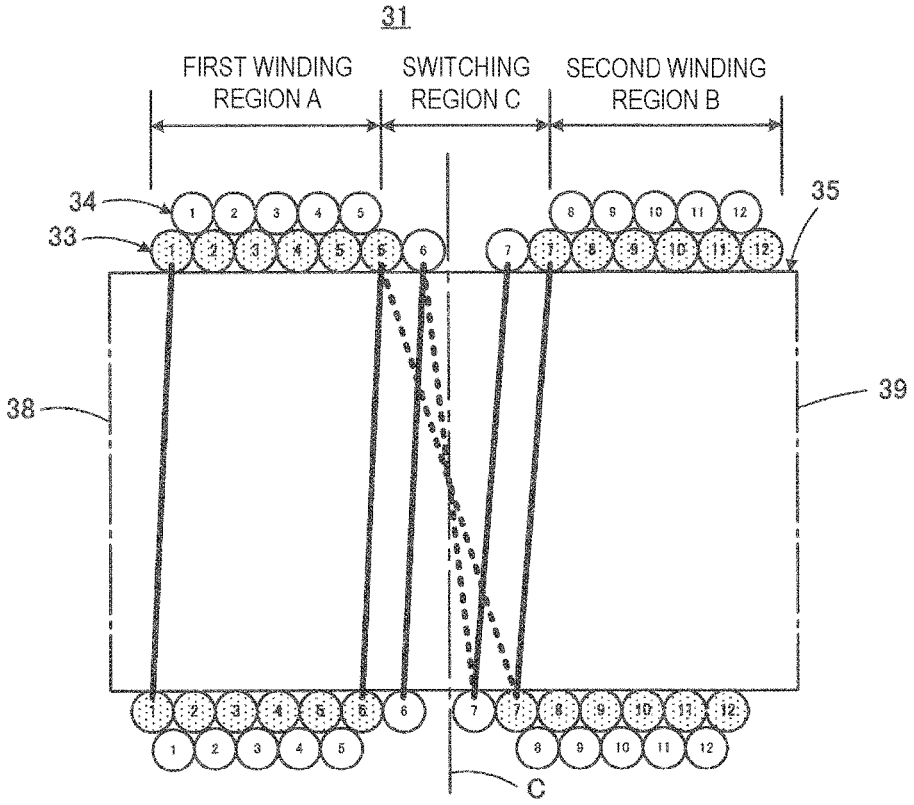
FIG. 13 is a cross-sectional view schematically illustrating, for the common mode choke coil illustrated in FIG. 11, the state of winding of the first and second wires described in Japanese Unexamined Patent Application Publication No. 2014-120730.

FIGS. 1A and 1B illustrate a common mode choke coil 51 according to a first embodiment of the present disclosure. The common mode choke coil 51 illustrated in FIGS. 1A and 1B differs from the common mode choke coil 31 illustrated in FIG. 11 mentioned above only in how the first and second wires 33 and 34 are wound, and is otherwise of substantially the same configuration as the common mode choke coil 31. Accordingly, in FIGS. 1A and 1B, elements corresponding to the elements illustrated in FIG. 11 are denoted by the same reference signs to avoid repetitive description.

In FIG. 1B, the first wire 33 and the second wire 34 are schematically depicted darkened and hollow, respectively, to clearly distinguish the first wire 33 and the second wire 34 from each other.

Figure 2:
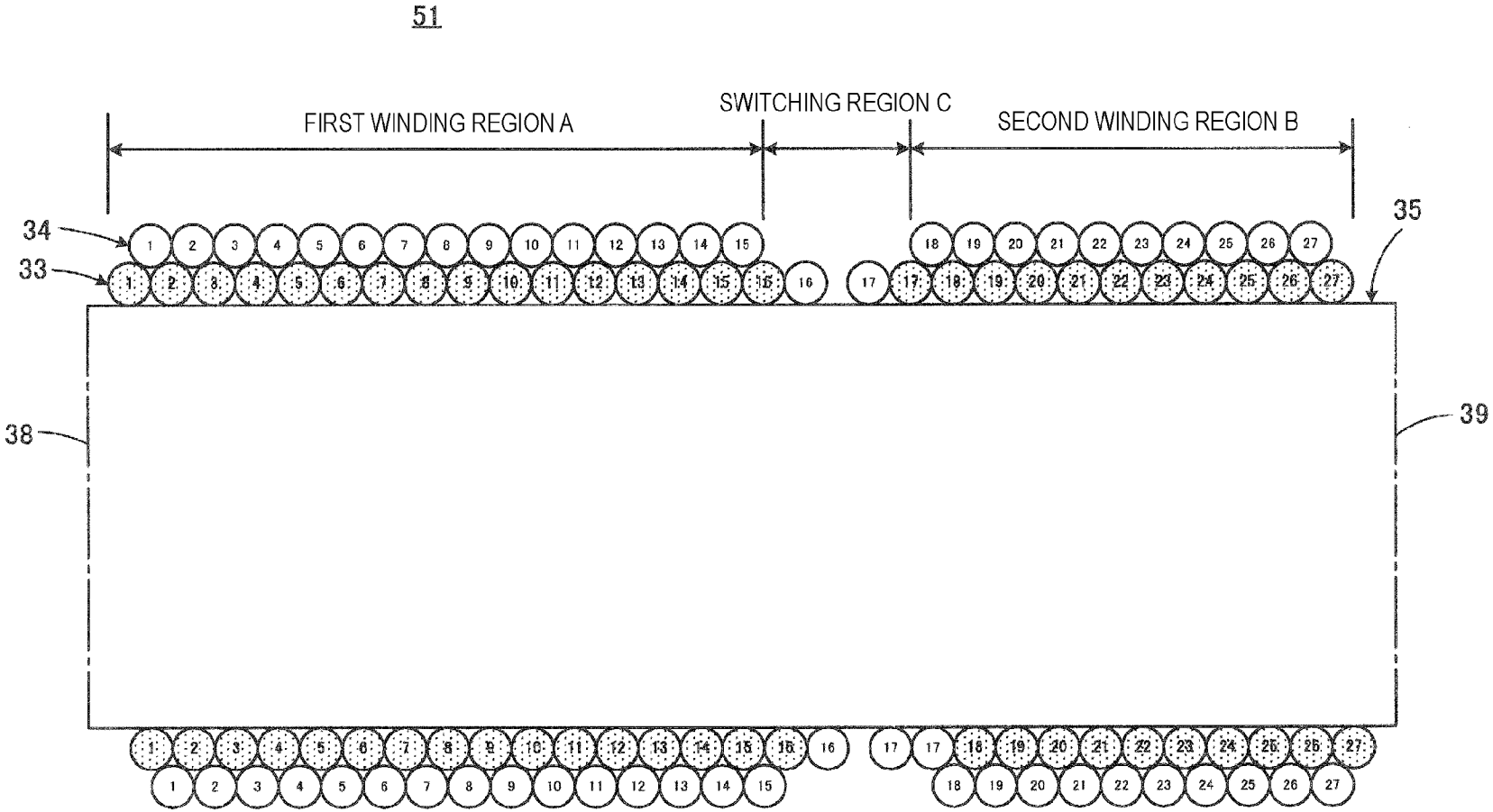
FIG. 2 is a cross-sectional view schematically illustrating the state of winding of first and second wires in the common mode choke coil illustrated in FIG. 1B.
Figure 3:
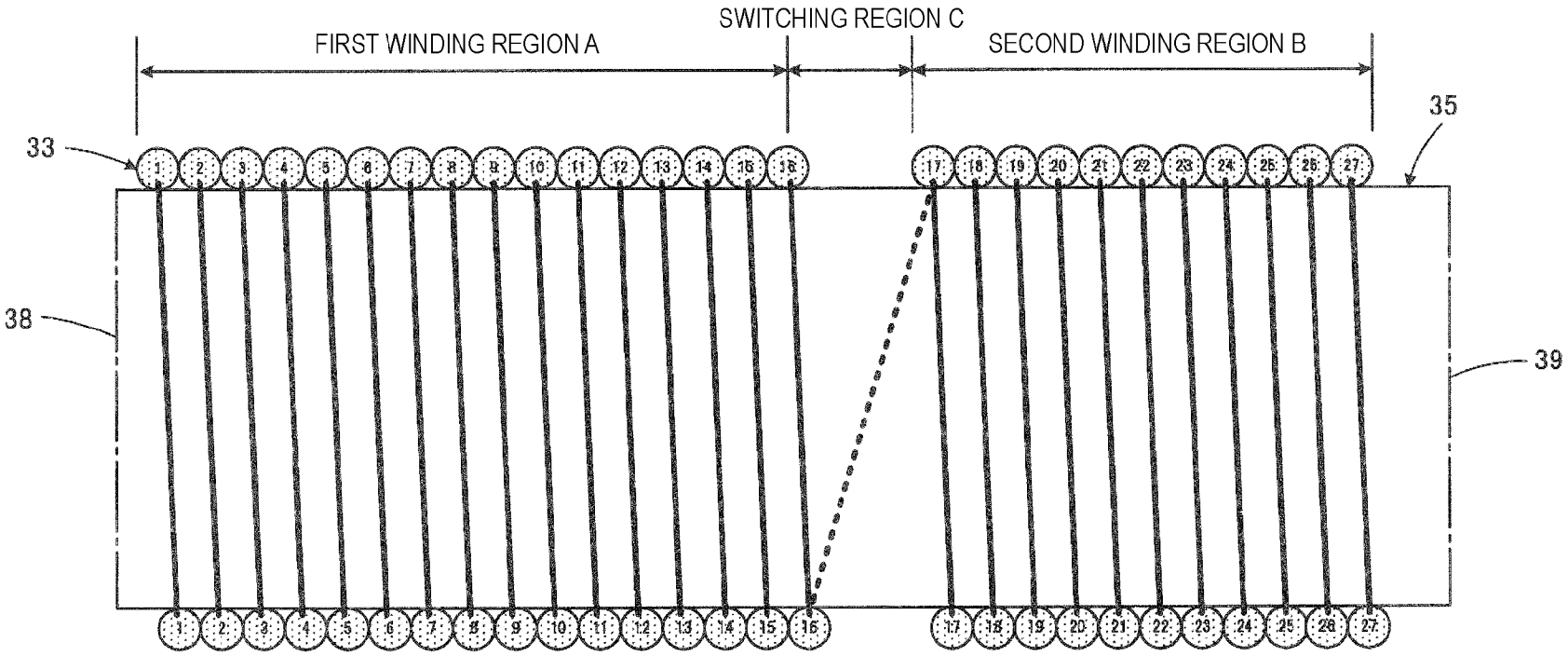
FIG. 3 is a cross-sectional view for explaining the procedure for winding the first wire illustrated in FIG. 2.
Figure 4:
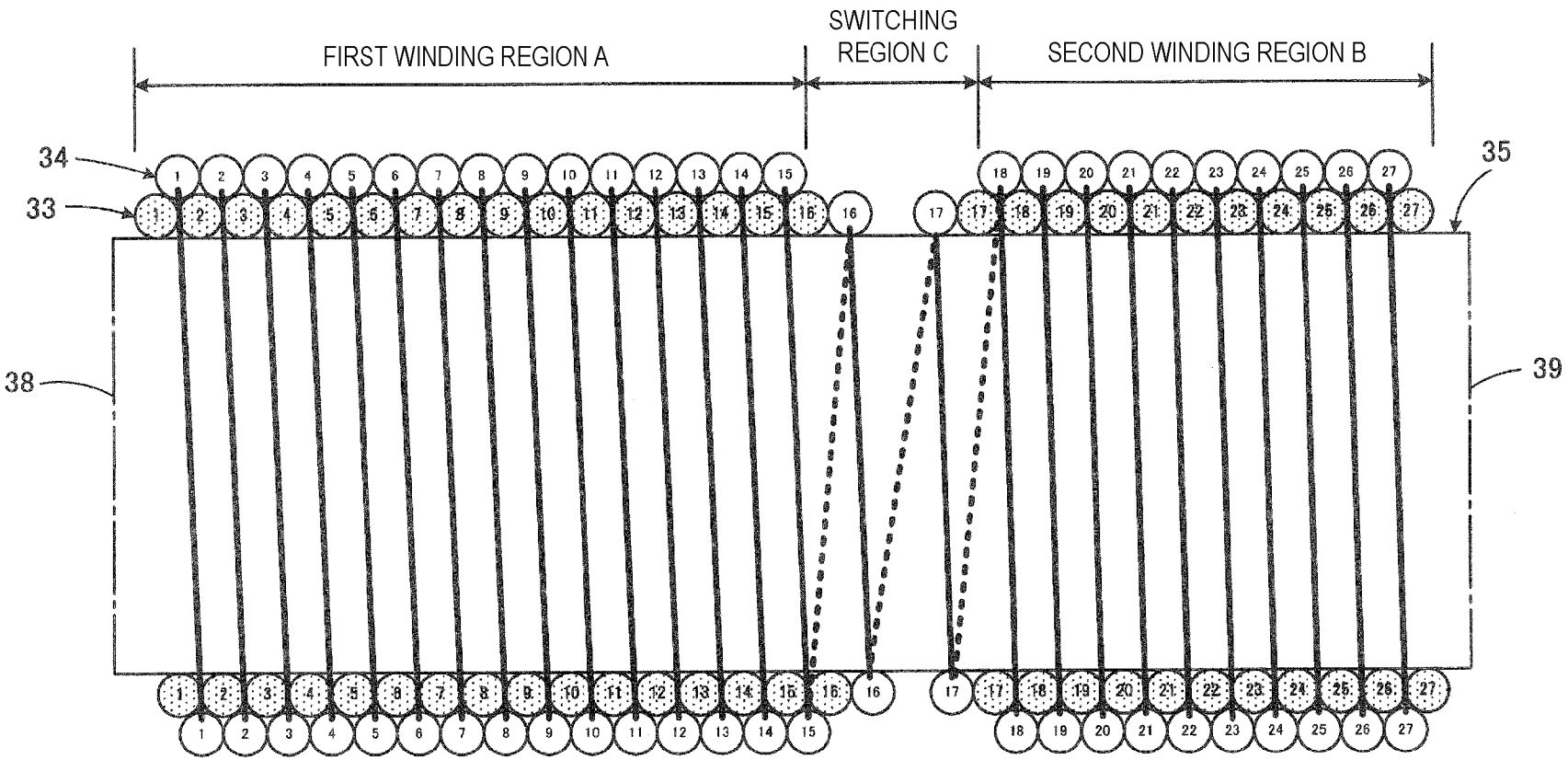
FIG. 4 is a cross-sectional view for explaining the procedure for winding the second wire illustrated in FIG. 2.

The state of winding of the first and second wires 33 and 34 in the common mode choke coil 51 illustrated in FIGS. 1A and 1B is depicted as a schematic cross-sectional view in FIG. 2. As can be appreciated from a comparison between FIG. 1B and FIG. 2, the number of turns of the wires 33 and 34 illustrated in FIG. 1B is less than the number of turns illustrated in FIG. 2, indicating that the wires 33 and 34 are depicted with some details omitted in FIG. 1B. In FIGS. 2 to 4, the cross-sections representing the first wire 33 are shaded to clearly distinguish the first wire 33 from the second wire 34.

The first and second wires 33 and 34 are wound around the winding core part 35 in a substantially helical manner with a substantially equal number of turns while running parallel to each other from the first end portion 38 where the first flange part 36 is located toward the second end portion 39 where the second flange part 37 is located. Further, the ordinal numbers of turns "1" to "27" as counted from the first end portion 38 of the winding core part 35 are written within the respective cross-sections of the first and second wires 33 and 34 illustrated in FIG. 2. The ordinal number of turns written within the respective cross-sections of the first and second wires 33 and 34 are also similarly written in FIGS. 3, 4, and 10.

The first wire 33 is wound so as to form a first layer that contacts the peripheral surface of the winding core part 35, and the second wire 34 is wound so as to form a second layer on the outer side of the first layer, with the part of the second wire 34 fitting in the recess defined between adjacent turns of the first wire 33.

The state of winding of the first and second wires 33 and 34 will be described in detail with reference to FIGS. 3 and 4 in conjunction with FIG. 2. In FIGS. 3 and 4, among various portions of the first and second wires 33 and 34 wound around the winding core part 35, the portions located forward of the winding core part 35 and the portions hidden behind the winding core part 35 are schematically indicated respectively by solid and broken lines. As for the broken lines indicating the portions of the wires 33 and 34 hidden behind the winding core part 35, not all of the broken lines are depicted but only those for characteristic locations are depicted.

In FIGS. 2 to 4, the "first winding region A", the "switching region C", and the "second winding region B" are depicted in this order from the first end portion 38 of the winding core part 35 toward the second end portion 39. That is, the winding core part 35 has the first winding region A, the switching region C, and the second winding region B in this order along the axis of the winding core part 35. The state of winding of the first and second wires 33 and 34 will be described below separately for each of the regions A to C.

First, the start edge of the first wire 33 is connected to the first terminal electrode 41 (see FIG. 1B).

Then, as clearly illustrated in FIG. 3, the 1st to 15th turns of the first wire 33 are wound in the first winding region A with no gap between adjacent turns.

Then, in the switching region C, which is located at the position of the transition from the 16th turn of the first wire 33 to the 17th turn, a gap is created between the 16th and 17th turns of the first wire 33.

Then, in the second winding region B, the 18th to 27th turns of the first wire 33 are wound, again with no gap between adjacent turns.

Then, the end edge of the first wire 33 is connected to the third terminal electrode 43 (see FIG. 1B).

As for the second wire 34, its start edge is connected to the second terminal electrode 42 (see FIG. 1B).

Then, as clearly illustrated in FIG. 4, the 1st to 15th turns of the second wire 34 are wound in the first winding region A such that the 1st turn of the second wire 34 fits in the recess defined between, for example, the 1st and 2nd turns of the first wire 33, or stated in a more generalized way, the nth turn of the second wire 34 fits in the recess defined between the nth and (n+1)-th turns of the first wire 33.

Next, in the switching region C, the 16th turn of the second wire 34 is wound with a gap between the 16th turn and the 15th turn, and further, the 17th turn of the second wire 34 is wound with a gap between the 17th turn and the 16th turn. The 16th and 17th turns of the second wire 34 are wound in contact with the peripheral surface of the winding core part 35. As can be appreciated from a comparison between FIG. 3 and FIG. 4, the second wire 34 crosses the first wire 33 at this time.

Then, in the second winding region B, the 18th to 27th turns of the second wire 34 are wound such that after a gap is created between the 18th turn of the second wire 34 and the 17th turn of the second wire 34, the 18th turn of the second wire 34 fits in the recess defined between the 17th and 18th turns of the first wire 33, or stated in a more generalized way, the (n+1)-th turn of the second wire 34 fits in the recess defined between the nth and (n+1)-th turns of the first wire 33.

Then, the end edge of the first wire 34 is connected to the fourth terminal electrode 44 (see FIG. 1B).

Characteristic features that can be found from the winding state mentioned above will be listed below.

First, in the first winding region A, the respective same-numbered turns of the first and second wires 33 and 34 lie adjacent to each other, with each turn of the first wire 33 being located closer to the first end portion 38 than the corresponding same-numbered turn of the second wire 34.

In the second winding region B, the respective same-numbered turns of the first and second wires 33 and 34 lie adjacent to each other, with each turn of the first wire 33 being located closer to the second end portion 39 than the corresponding same-numbered turn of the second wire 34.

In the switching region C, the first wire 33 and the second wire 34 cross each other so that the relative positions of the turns of the first wire 33 and the turns of the second wire 34 are switched.

Further, the number of turns of each of the first and second wires 33 and 34 differs from the number of turns of the first and second wires in the second winding region B. That is, in the first winding region A, the number of turns of the first wire 33 is "15", and the number of turns of the second wire 34 is "15", whereas in the second winding region B, the number of turns of the first wire 33 is "10", and the number of turns of the second wire 34 is "10".

From a comparison between the number of turns of each of the first and second wires 33 and 34 in the first winding region A and the number of turns of each of the first and second wires 33 and 34 in the second winding region B, the following observations can be made.

For the first wire 33, its number of turns "15" in the first winding region A is exactly 1.5 times its number of turns "10" in the second winding region B. For the second wire 34, its number of turns "15" in the first winding region A is exactly 1.5 times its number of turns "10" in the second winding region B. That is, the number of turns of each of the first and second wires 33 and 34 in the first winding region A is more than or equal to 1.5 times that in the second winding region B.

Further, for the first wire 33, its number of turns "10" in the second winding region B is five less than its number of turns "15" in the first winding region A. For the second wire 34, its number of turns "10" in the second winding region B is five less than its number of turns "15" in the first winding region A. That is, a difference between the number of turns of each of the first and second wires 33 and 34 in the first winding region A and the number of turns of each of the first and second wires 33 and 34 in the second winding region B is more than or equal to five.

The above-mentioned asymmetry introduced by making the number of turns of each of the first and second wires 33 and 34 differ between the first winding region A and the second winding region B introduces directionality to the electrical characteristics of the common mode choke coil 51. The resulting configuration has been found to provide improved mode conversion characteristics compared to physically symmetric configurations. This will be described below with reference to FIGS. 5 to 9.

Figure 5:
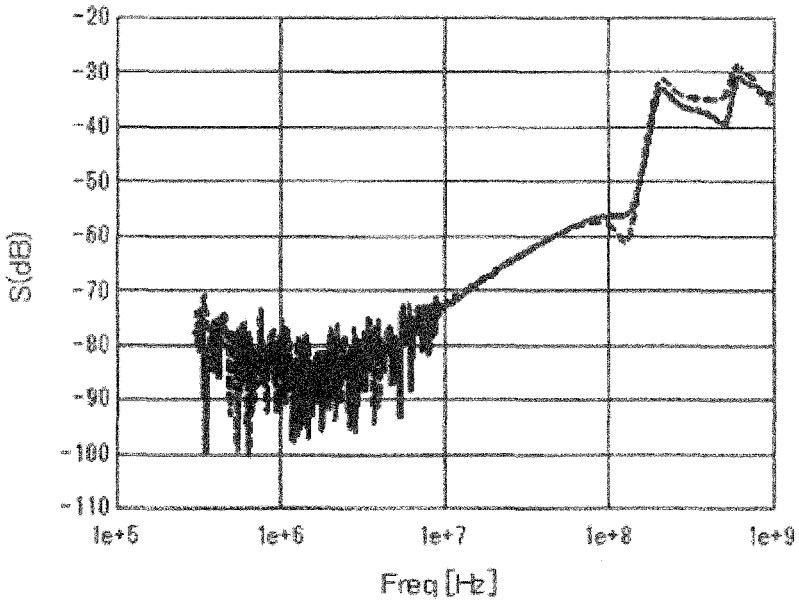
FIG. 5 illustrates the S-parameter frequency characteristics of a common mode choke coil in which the number of turns of each of the first and second wires in a first winding region and the number of turns of each of the first and second wires in a second winding region are substantially equal, with the solid line indicating a case in which a signal is input from the side where first and second terminal electrodes are located, and the broken line indicating a case in which a signal is input from the side where third and fourth terminal electrodes are located.
Figure 6:
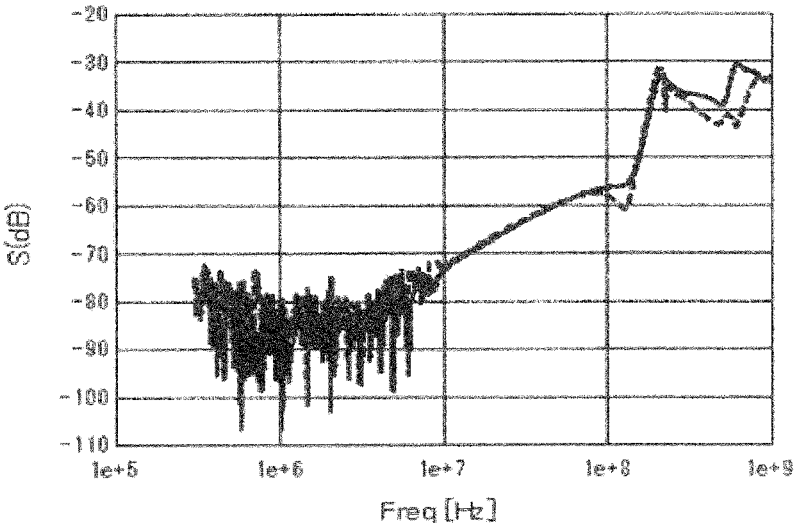
FIG. 6 illustrates the S-parameter frequency characteristics of a common mode choke coil in which the number of turns of each of the first and second wires in the second winding region is one less than the number of turns of each of the first and second wires in the first winding region, with the solid line indicating a case in which a signal is input from the side where the first and second terminal electrodes are located, and the broken line indicating a case in which a signal is input from the side where the third and fourth terminal electrodes are located.
Figure 7:
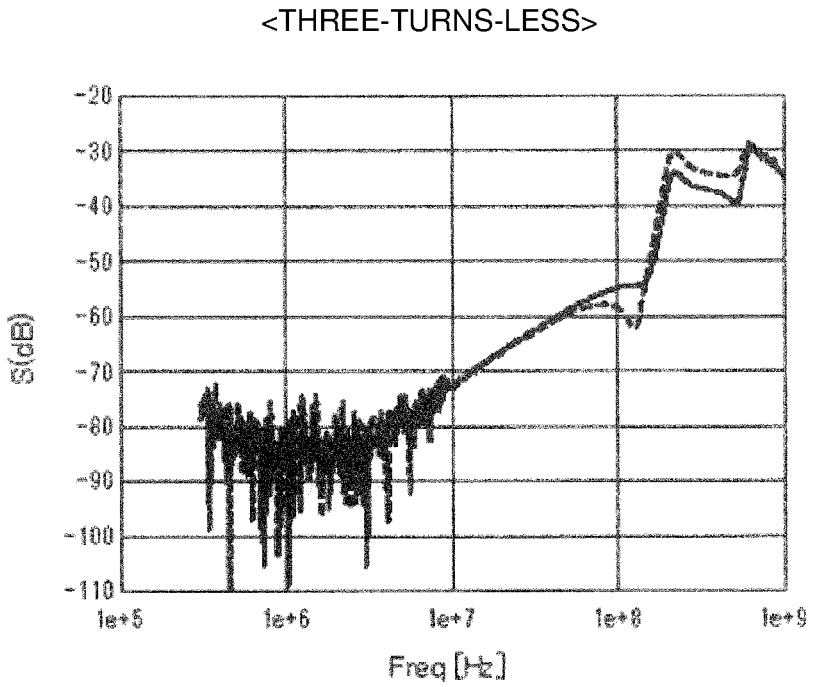
FIG. 7 illustrates the S-parameter frequency characteristics of a common mode choke coil in which the number of turns of each of the first and second wires in the second winding region is three less than the number of turns of each of the first and second wires in the first winding region, with the solid line indicating a case in which a signal is input from the side where the first and second terminal electrodes are located, and the broken line indicating a case in which a signal is input from the side where the third and fourth terminal electrodes are located.
Figure 8:
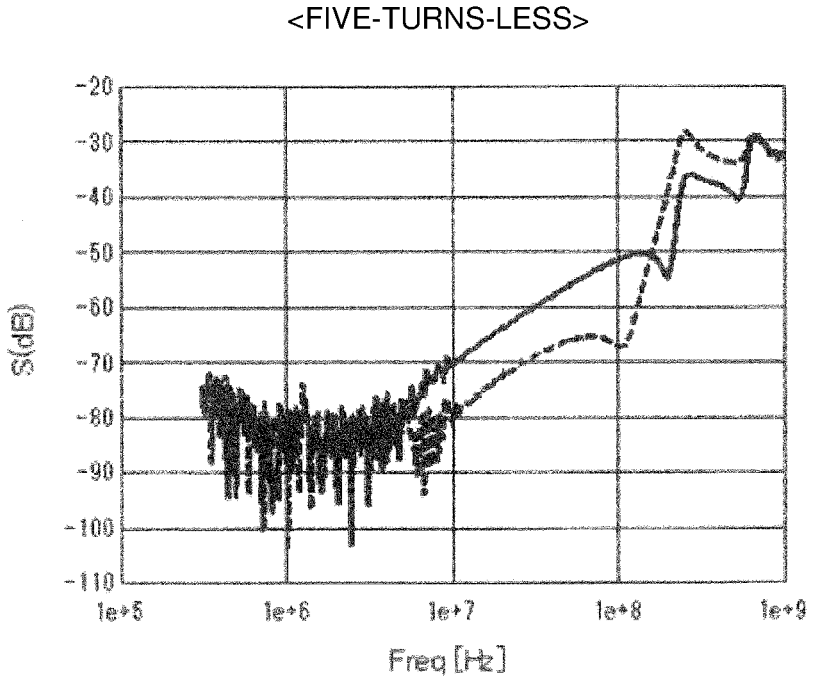
FIG. 8 illustrates the S-parameter frequency characteristics of a common mode choke coil in which the number of turns of each of the first and second wires in the second winding region is five less than the number of turns of each of the first and second wires in the first winding region, with the solid line indicating a case in which a signal is input from the side where the first and second terminal electrodes are located, and the broken line indicating a case in which a signal is input from the side where the third and fourth terminal electrodes are located.

FIGS. 5 to 9 each illustrate the S-parameter frequency characteristics of a common mode choke coil. In each of FIGS. 5 to 9, the solid line indicates a case in which the signal is input in the forward direction, that is, from the side of the common mode choke coil where the first and second terminal electrodes are located, and the broken line indicates a case in which the signal is input in the reverse direction, that is, from the opposite side of the common mode choke coil where the third and fourth terminal electrodes are located. With regard to the number of turns of each of the first and second wires in the first winding region, T1, and the number of turns of each of the first and second wires in the second winding region, T2, FIGS. 5 to 9 illustrate the following cases:

FIG. 5 illustrates a case in which T1=15 and T2=15 (equal-number-of-turns);

FIG. 6 illustrates a case in which T1=15 and T2=14 (one-turn-less);

FIG. 7 illustrates a case in which T1=15 and T2=12 (three-turns-less);

FIG. 8 illustrates a case in which T1=15 and T2=10 (five-turns-less); and

Figure 9:
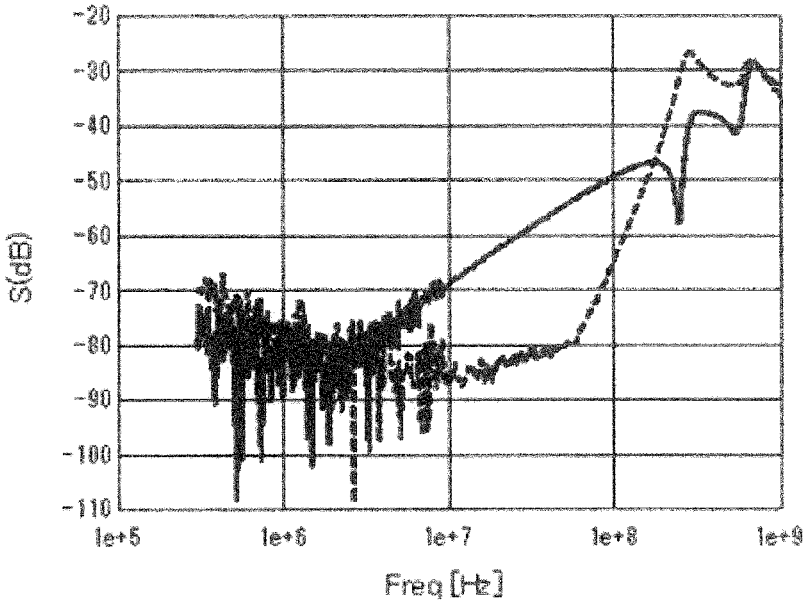
FIG. 9 illustrates the S-parameter frequency characteristics of a common mode choke coil in which the number of turns of each of the first and second wires in the second winding region is seven less than the number of turns of each of the first and second wires in the first winding region, with the solid line indicating a case in which a signal is input from the side where the first and second terminal electrodes are located, and the broken line indicating a case in which a signal is input from the side where the third and fourth terminal electrodes are located.

FIG. 9 illustrates a case in which T1=15 and T2=8 (seven-turns-less).

Lower S-parameter values illustrated in FIGS. 5 to 9 indicate improved mode conversion characteristics, that is, reduced mode conversion.

With the "equal-number-of-turns" arrangement illustrated in FIG. 5, owing to the above-mentioned inability to achieve a perfectly symmetrical winding structure, S-parameter values do not match but very similar characteristics are obtained between the case of the forward direction indicated by the solid line and the case of the reverse direction indicated by the broken line.

With the "one-turn-less" arrangement illustrated in FIG. 6, at lower frequencies, there is substantially no difference in S-parameter values between the case of the forward direction indicated by the solid line and the case of the reverse direction indicated by the broken line, but at higher frequencies, slightly lower S-parameter values are obtained in the case of the reverse direction indicated by the broken line than in the case of the forward direction indicated by the solid line.

In the case of the three-turns-less arrangement illustrated in FIG. 7, at lower frequencies, there is substantially no difference in S-parameter values between the case of the forward direction indicated by the solid line and the case of the reverse direction indicated by the broken line, but at higher frequencies, slightly lower S-parameter values are obtained in the case of the forward direction indicated by the solid line than in the case of the reverse direction indicated by the broken line.

With the "five-turns-less" arrangement illustrated in FIG. 8, at lower frequencies, clearly lower S-parameter values are obtained in the case of the reverse direction indicated by the broken line than in the case of the forward direction indicated by the solid line, and at higher frequencies, clearly lower S-parameter values are obtained in the case of the forward direction indicated by the solid line than in the case of the reverse direction indicated by the broken line. The "five-turns-less" arrangement illustrated in FIG. 8 corresponds to the embodiment illustrated in FIG. 2.

With the "seven-turns-less" arrangement illustrated in FIG. 9, at lower frequencies, clearly lower S-parameter values are obtained in the case of the reverse direction indicated by the broken line than in the case of the forward direction indicated by the solid line, and at higher frequencies, clearly lower S-parameter values are obtained in the case of the forward direction indicated by the solid line than in the case of the reverse direction indicated by the broken line.

As can be appreciated from the trend of S-parameter values mentioned above, when a difference between T1 and T2 is more than or equal to five, or in terms of the ratio between T1 and T2, when T1 is more than or equal to 1.5 times of T2 as in the case of the "five-turns-less" arrangement illustrated in FIG. 8 and the "seven-turns-less" arrangement illustrated in FIG. 9, a noticeable difference appears between the case of the forward direction indicated by the solid line and the case of the reverse direction indicated by the broken line, and thus a clear directionality is observed. Therefore, according to the present disclosure, it is preferable that a difference between T1 and T2 is more than or equal to five, or T1 is more than or equal to 1.5 times of T2. It is to be noted, however, that some directionality is obtained as long as T1 and T2 are different from each other, even if their difference or ratio is outside the preferred range mentioned above.

In actual use of the common mode choke coil, in the case of, for example, the "five-turns-less" arrangement illustrated in FIG. 8 and the "seven-turns-less" arrangement illustrated in FIG. 9, it is recommended to mount the common mode choke coil in such a way that the signal flows in the reverse direction during use at lower frequencies, and mount the common mode choke coil in such a way that the signal flows in the forward direction during use at higher frequencies.

Since directionality develops in the electrical characteristics of the common mode choke coil as described above, as illustrated in FIG. 1A, the common mode choke coil 51 preferably has a mark 52 provided on, for example, the top plate 45 to discriminate between the first flange part 36 and the second flange part 37. This allows the common mode choke coil 51 to be mounted in an orientation (forward or reverse) that makes it possible to obtain desired frequency characteristics. From this point of view, the mark 52 may be any mark that can be identified by a mounting apparatus. If the mark 52 is made visually identifiable, this facilitates handling of the common mode choke coil 51 during the manufacturing process. Specifically, for example, even if an error such as an error in the transport of the common mode choke coil 51 occurs during the packaging process in which the common mode choke coil 51 is taped onto a reel, the orientation of the common mode choke coil 51 can be identified/corrected on the spot, thus allowing the process to be readily resumed.

The mark 52 is formed by, for example, a laser. The mark 52 may be made on, for example, the core 32 instead of the top plate 45 as illustrated in FIG. 1A. The mark 52 may not necessarily be in the form of the geometrical figure as illustrated in FIG. 1A. As long as the mark 52 allows the first flange part 36 and the second flange part 37 to be discriminated from each other, the mark 52 may be in the form of other geometrical figures, or may be in the form of, for example, numerals, letters, or symbols. Further, the mark 52 may be substituted for by numbers such as the product numbers or lot numbers to be assigned to individual products.

If, like the mark 52 of a substantially circular shape illustrated in FIG. 1A, the mark used is one with no spatial distinctions such as top/bottom or left/right in itself, then the mark 52 is made at a position offset toward one side of the top plate 45, for example. In this case, the orientation of the common mode choke coil 51 can be identified based on where the mark 52 is located.

If the number of turns of the wires 33 and 34 differs relatively greatly between the first winding region A and the second winding region B, the orientation of the common mode choke coil 51 can be easily recognized simply by visually checking the state of winding of the wires 33 and 34. This allows the orientation of the common mode choke coil 51 to be identified at some midway point during the manufacturing process, for example, prior to attaching the top plate 45 to the core 32. Although it can be said that there is no particular need to provide the mark 52 in this case, the following advantage can be also anticipated with such an arrangement: in providing the mark 52, it is possible to prevent the mark 52 from being made in a wrong way. During mounting of the common mode choke coil 51, the location of the top plate 45 coincides with the location where a nozzle picks up the common mode choke coil 51. Therefore, if the mark 52 is made on the top plate 45, pickup of the common mode choke coil 51 by the mounting apparatus and identification of the orientation of the common mode choke coil 51 can be performed simultaneously, allowing for a streamlined mounting process.

Figure 10:
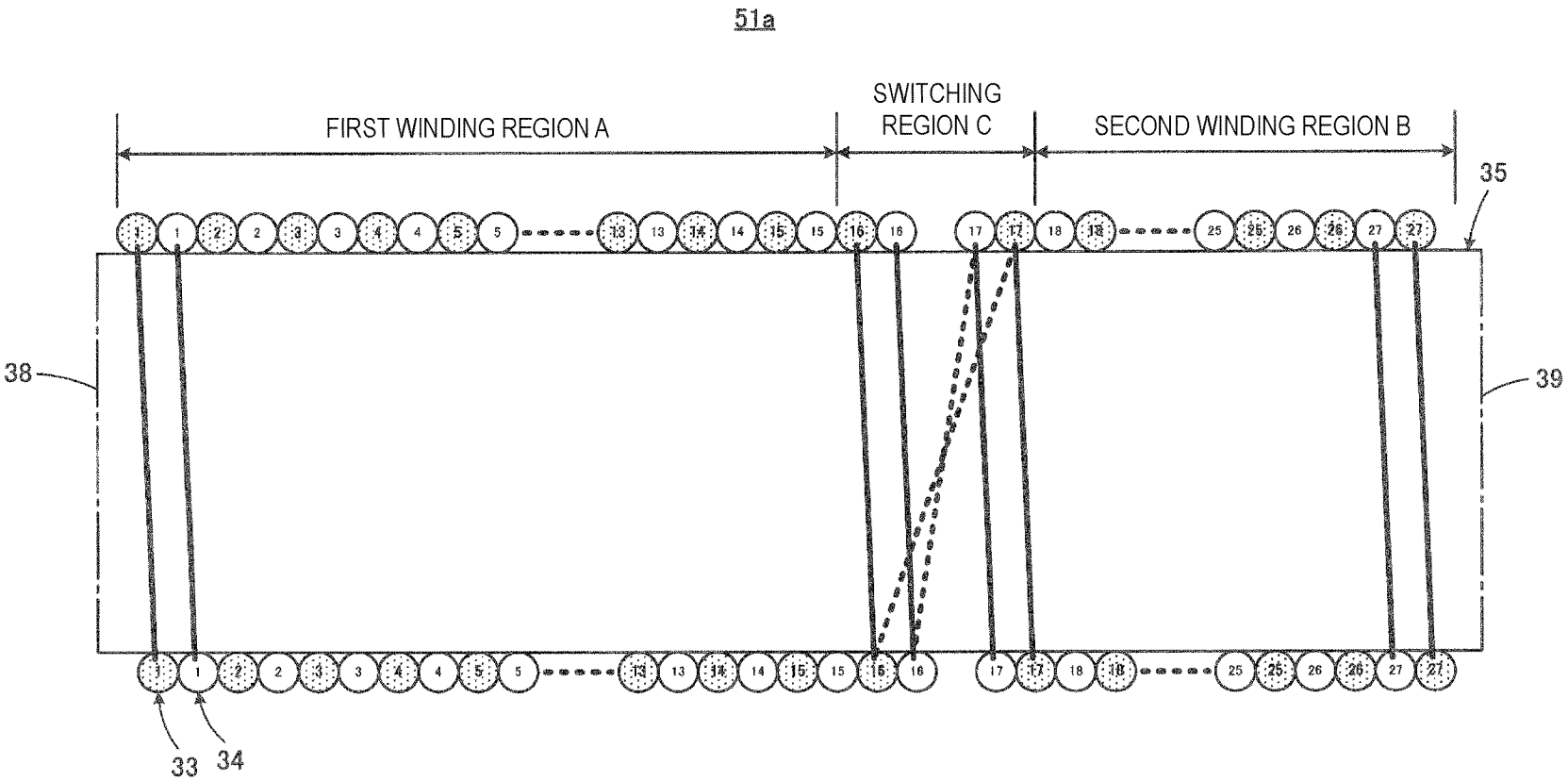
FIG. 10 is an illustration corresponding to FIG. 2 for explaining a second embodiment of the present disclosure.

Next, referring to FIG. 10, a common mode choke coil 51*a* according to a second embodiment of the present disclosure will be described. Like FIG. 2, FIG. 10 illustrates the state of winding of the first and second wires 33 and 34 in the common mode choke coil 51*a*. Accordingly, in FIG. 10, elements corresponding to the elements illustrated in FIG. 2 are denoted by the same reference signs to avoid repetitive description.

In the common mode choke coil 51*a* illustrated in FIG. 10, the first wire 33 and the second wire 34 are both wound in contact with the peripheral surface of the winding core part 35 while running parallel to each other.

The common mode choke coil 51*a* illustrated in FIG. 10 is the same as the common mode choke coil 51 illustrated in FIG. 2 with regard to which one of the followings is to be located closer to the first or second end portion 38 or 39 in each of the first winding region A and the second winding region B: a given turn of the first wire 33 and the corresponding same-numbered turn of the second wire 34.

That is, in the first winding region A, each turn of the first wire 33 is located closer to the first end portion 38 than the corresponding same-numbered turn of the second wire 34.

In the second winding region B, each turn of the first wire 33 is located closer to the second end portion 39 than the corresponding same-numbered turn of the second wire 34.

In the switching region C, the first wire 33 and the second wire 34 cross each other so that the relative positions of the turns of the first wire 33 and the turns of the second wire 34 are switched.

More specifically, in the first winding region A, the 1st to 15th turns of each of the first and second wires 33 and 34 are wound such that the respective same-numbered turns of the first and second wires 33 and 34 lie adjacent to each other, with the first wire 33 preceding the second wire 34.

Then, in the switching region C, which is located at the position of the transition from the 16th turn of the first wire 33 to the 17th turn, a gap is created between the 16th and 17th turns of the first wire 33. The switching region C is also located at the position of the transition from the 16th turn of the second wire 34 to the 17th turn, with a gap being created between the 16th and 17th turns of the second wire 34. Further, in the switching region C, the second wire 34 crosses the first wire 33.

Then, in the second winding region B, the 18th to 27th turns of each of the first and second wires 33 and 34 are wound such that the respective same-numbered turns of the first and second wires 33 and 34 lie adjacent to each other, with the second wire 34 preceding the first wire 33.

In the case of the embodiment illustrated in FIG. 10 as well, the number of turns of each of the first and second wires 33 and 34 is made to differ between the first winding region A and the second winding region B. That is, in the first winding region A, the number of turns of the first wire 33 is "15", and the number of turns of the second wire 34 is "15", whereas in the second winding region B, the number of turns of the first wire 33 is "10", and the number of turns of the second wire 34 is "10".

Therefore, for the first wire 33, its number of turns "15" in the first winding region A is exactly 1.5 times its number of turns "10" in the second winding region B. For the second wire 34, its number of turns "15" in the first winding region A is exactly 1.5 times its number of turns "10" in the second winding region B. That is, the number of turns of each of the first and second wires 33 and 34 in the first winding region A and the number of turns of each of the first and second wires 33 and 34 in the second winding region B have a ratio such that one of the numbers of turns in the first and second winding regions is about 1.5 times or more greater than the other.

Further, for the first wire 33, its number of turns "10" in the second winding region B is five less than its number of turns "15" in the first winding region A. For the second wire 34, its number of turns "10" in the second winding region B is five less than its number of turns "15" in the first winding region A. That is, the number of turns of each of the first and second wires 33 and 34 in the first winding region A and the number of turns of each of the first and second wires 33 and 34 in the second winding region B have a difference such that one of the numbers of turns in the first and second winding regions is about five or more less than the other.

As described above, asymmetry is also achieved for the common mode choke coil 51*a* according to the second embodiment such that the number of turns of each of the first and second wires 33 and 34 is made to differ between the first winding region A and the second winding region B. As in the first embodiment, this configuration introduces directionality to the electrical characteristics of the common mode choke coil 51*a*. The resulting configuration provides improved mode conversion characteristics compared to physically symmetric configurations.

Although the present disclosure has been described above with reference to the illustrated embodiments of a common mode choke coil, various other modifications are possible within the scope of the present disclosure.

For example, the number of turns of each of the first and second wires included in the common mode choke coil may be increased or decreased to any value that satisfies the conditions set forth in the present disclosure. Accordingly, depending on how many turns each of the first and second wires is wound in the first winding region and how many turns each of the first and second wires is wound in the second winding region, the numbers of turns that is 1.5 times the numbers of turns in one region which is the first winding region or the second winding region may not be the same as the numbers of turns that is five less than the numbers of turns in the one region.

The direction in which the number of turns is counted may be reversed from the direction described above with reference to the embodiments.

Although the first and second wires 33 and 34 are located in immediate proximity to each other in the first winding region A and the second winding region B in the above embodiments, this is not to be construed restrictively. A slight gap may be present between the first and second wires 33 and 34.

Although an explicit space is illustrated to exist between the first and second wires 33 and 34 in the switching region C in the above embodiments, this space is not always necessary. The only requirement in this regard is that in the switching region, the two wires cross each other to have their relative positions switched. Specifically, for example, the relative positions of the two wires may be switched by winding one of the wires in closely spaced turns while winding the other wire in widely spaced turns.

It is to be noted that the embodiments illustrated are intended to be illustrative, and among different embodiments, some of their features may be substituted for or combined with each other.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A common mode choke coil comprising:

a core having a winding core part, and a first flange part and a second flange part respectively provided in a first end portion and a second end portion of the winding core part, the first and second end portions being located opposite to each other;

a first wire and a second wire that are wound around the winding core part in a substantially helical manner with a substantially equal number of turns while running parallel to each other;

a first terminal electrode and a second terminal electrode that are provided in the first flange part, the first terminal electrode and the second terminal electrode being respectively connected with a first end of the first wire and a first end of the second wire; and a third terminal electrode and a fourth terminal electrode that are provided in the second flange part, the third terminal electrode and the fourth terminal electrode being respectively connected with a second end of the first wire and a second end of the second wire, wherein the winding core part has a first winding region, a switching region, and a second winding region in this order along an axis of the winding core part, in the first winding region, respective same-numbered turns of the first and second wires lie adjacent to each other with each turn of the first wire being located closer to the first end portion than a corresponding same-numbered turn of the second wire, in the second winding region, respective same-numbered turns of the first and second wires lie adjacent to each other with each turn of the first wire being located closer to the second end portion than a corresponding same-numbered turn of the second wire, in the switching region, the first wire and the second wire cross each other such that relative positions of turns of the first wire and turns of the second wire are switched, a number of turns of the first and second wires in the first winding region differs from a number of turns of the first and second wires in the second winding region, the number of turns of the first and second wires in one region of the first winding region and the second winding region is at least 1.5 times that in the other region of the first winding region and the second winding region, and the number of turns of each of the first and second wires in the first winding region is different from the number of turns of each of the first and second wires in the second winding region by at least five.

2. The common mode choke coil according to claim 1, further comprising a mark that discriminates between the first flange part and the second flange part.

3. The common mode choke coil according claim 1, wherein the first wire is wound such that the first wire forms a first layer in contact with a peripheral surface of the winding core part, and in the first and second winding regions, the second wire is wound such that the second wire forms a second layer on an outer side of the first layer, with a part of the second wire fitting in a recess defined between adjacent turns of the first wire.

4. The common mode choke coil according to claim 1, wherein in the first and second winding regions, the first wire and the second wire are both wound in contact with a peripheral surface of the winding core part.

5. A common mode choke coil comprising:

a core having a winding core part, and a first flange part and a second flange part respectively provided in a first end portion and a second end portion of the winding core part, the first and second end portions being located opposite to each other;

a first wire and a second wire that are wound around the winding core part in a substantially helical manner with a substantially equal number of turns while running parallel to each other;

a first terminal electrode and a second terminal electrode that are provided in the first flange part, the first terminal electrode and the second terminal electrode being respectively connected with a first end of the first wire and a first end of the second wire; and a third terminal electrode and a fourth terminal electrode that are provided in the second flange part, the third terminal electrode and the fourth terminal electrode being respectively connected with a second end of the first wire and a second end of the second wire, wherein the winding core part has a first winding region, a switching region, and a second winding region in this order along an axis of the winding core part, in the first winding region, respective same-numbered turns of the first and second wires lie adjacent to each other with each turn of the first wire being located closer to the first end portion than a corresponding same-numbered turn of the second wire, in the second winding region, respective same-numbered turns of the first and second wires lie adjacent to each other with each turn of the first wire being located closer to the second end portion than a corresponding same-numbered turn of the second wire, in the switching region, the first wire and the second wire cross each other such that relative positions of turns of the first wire and turns of the second wire are switched, a number of turns of the first and second wires in the first winding region differs from a number of turns of the first and second wires in the second winding region, and the number of turns of each of the first and second wires in the first winding region is different from the number of turns of each of the first and second wires in the second winding region by at least five.

6. The common mode choke coil according to claim 5, further comprising a mark that discriminates between the first flange part and the second flange part.

7. The common mode choke coil according claim 5, wherein the first wire is wound such that the first wire forms a first layer in contact with a peripheral surface of the winding core part, and in the first and second winding regions, the second wire is wound such that the second wire forms a second layer on an outer side of the first layer, with a part of the second wire fitting in a recess defined between adjacent turns of the first wire.

8. The common mode choke coil according to claim 5, wherein in the first and second winding regions, the first wire and the second wire are both wound in contact with a peripheral surface of the winding core part.

* * * * *